US007284640B2

(12) United States Patent
Lee

(10) Patent No.: US 7,284,640 B2
(45) Date of Patent: Oct. 23, 2007

(54) SYSTEM OF ENHANCING AIR QUALITY USED FOR BUILDINGS

(76) Inventor: Nien-Chin Lee, 4F., No. 23, Lane 87, Hsin-Sheng Street, Pan Chiao, Taipei Hsien (TW)

( * ) Notice: Subject to any disclaimer, the term of this patent is extended or adjusted under 35 U.S.C. 154(b) by 622 days.

(21) Appl. No.: 10/878,998

(22) Filed: Jun. 30, 2004

(65) Prior Publication Data

US 2005/0000754 A1 Jan. 6, 2005

(30) Foreign Application Priority Data

Jul. 3, 2003 (TW) ..... 92118157 A

(51) Int. Cl.
*B66B 7/00* (2006.01)

(52) U.S. Cl. ..... 187/413; 454/68

(58) Field of Classification Search ..... 187/277, 187/293, 314, 413, 414; 454/68
See application file for complete search history.

(56) References Cited

U.S. PATENT DOCUMENTS 2,310,414 A * 2/1943 Fritzam et al. ..... 454/68
2,350,389 A * 6/1944 Coulton et al. ..... 454/68
2,532,268 A * 11/1950 Christmann ..... 62/259.1
4,592,270 A * 6/1986 Vener ..... 454/68
5,080,003 A * 1/1992 Kappeler ..... 454/68
5,306,208 A * 4/1994 Sommerrock et al. ..... 454/68
5,593,347 A * 1/1997 Mandy et al. ..... 454/68
6,902,040 B2 * 6/2005 Fujita et al. ..... 187/314
2004/0262094 A1 * 12/2004 Yoon ..... 187/401

FOREIGN PATENT DOCUMENTS

JP 03061279 A * 3/1991
JP 06024665 A * 2/1994
JP 06080357 A * 3/1994

* cited by examiner

*Primary Examiner*—Jonathan Salata
(74) *Attorney, Agent, or Firm*—Pearl Cohen Zedek Latzer LLP

(57) ABSTRACT

A system of enhancing air quality for buildings is proposed. The system includes a multi level building having a hoistway vertically extending through at least two levels of the building, for receiving a car vertically moving therein. The system further includes at least an air circulating device placed on a top level of the building for pumping fresh air into the hoistway, a plurality of current directing devices installed between different levels of the building for directing air in the hoistway flowing from an upper level of the building to a lower level of the building, and a waste discharge device in communication with an available exhaust outlet in a basement for discharging exhaust out of the hoistway. Accordingly, the air flowing in the hoistway is maintained in a single direction. With the system of enhancing air quality for buildings, dirty air discharged below the car is maintained to flow downwardly to prevent backflow of the dirty air, so as to achieve better air quality in the elevator.

20 Claims, 5 Drawing Sheets

SYSTEM OF ENHANCING AIR QUALITY USED FOR BUILDINGS

CROSS-REFERENCE TO RELATED APPLICATIONS

This application claims priority from Taiwanese Application No. 092118157, filed on Jul. 3, 2003.

BACKGROUND OF THE INVENTION

1. Field of the Invention

The present invention relates to a system of enhancing air quality, and more particularly, to a system of enhancing air quality by improving amount of air circulating in an elevator of a building using an air conditioning method, so as to ensure health of the elevator passengers.

2. Description of Related Art

Recently, new viral infection disease known as Severe Acute Respiratory Syndrome (SARS), which has affected many countries, necessitates a re-think about ventilation issues, particularly in enclosed spaces such as elevators, where people are forced into close proximity. However, a conventional elevator car is generally a closed compartment that has poor ventilation. This poses a potential risk of accumulation of hazard material such as corona virus, and increases chance of deadly viral infection for anyone traveling in the elevator, accordingly.

FIG. 5 illustrates a conventional elevating equipment (known generally as elevator) is installed in multi level building. The elevator comprises a hoistway 21' and an elevator car 20' received in the hoistway 21'. The hoistway 21' is connected with a plurality of venting ducts (not shown) that communicates with the outside of the multi-level building, so that air in the hoistway 21' can exchange with air outside to achieve an air convection. And even though the air in the hoistway can exchange with air outside, dirty air in the hoistway often reside at lower level of the building as a result of back flow and a relatively larger specific weight of the dirty air, making the air convection worse at the basement of the building. And as the back flowing dirty air is mixed with fresh air (having a relatively smaller specific weight) in the hoistway, air quality in the elevator car 20' is further degraded. Therefore, it is difficult to improve efficiency in exchanging dirty air with the fresh air in the elevator.

SUMMARY OF THE INVENTION

In view of the above, an object of the present invention is to provide a system of enhancing air quality for buildings by increase amount of air circulating in an elevator of a building, so that fresh air can quickly be introduced in an elevator car while dirty air is discharged out of the car in order to minimize chance of elevator passengers contracting with air-borne infectious disease (such as severe acute respiratory syndrome (SARS), fever, or tuberculosis).

Another objective of the present invention is to provide a system of enhancing air quality for buildings by increase amount of air circulating in an elevator of a building, so that fresh air can quickly be introduced in an elevator car while dirty air is discharged out of the car in order to minimize chance of the elevator passenger from being disturbed by irritating odors (such as smoke and fungus smell).

One other objective of the present invention is to provide a system of enhancing air quality for building without modifying current hoistway design for the building, so that the system can be implemented in the elevator of either an old or new type of the building.

A further objective of the present invention is to provide a system of enhancing air quality for buildings, whereby the amount of air venting in the hoistway is regulated by an alarm type auto-shut down system, so as to prevent flames from burning and damaging other levels of the building.

In order to achieve the above object, a levelsystem of enhancing air quality for buildings is provided and applicable to a multi level building with more than three level and equipped with elevating equipment, such as passenger elevator, cargo elevator, or other similar elevators in such a way as to match with the currently available elevator hoistway and the exhaust discharge device in the basement, so that the air circulation in the elevator is improved to ensure the passengers enjoying better air quality in the elevator.

The system of enhancing air quality for buildings comprises a multi level building having a hoistway vertically extending through at least two stories of the multi level building for receiving a car moving vertically therein, and a basement exhaust discharge device in communication with the hoistway. At least an air feeding device and an air extracting device are formed in the car to enhance convectional circulation of air in the car via the system of enhancing air quality for buildings, so that a better air quality is achieved in the car. The system comprises of at least a air circulating device installed on a top level of the multi-storied building for introducing fresh air into the hoistway; a plurality of current directing devices installed between two different levels, for directing air currents in the hoistway flowing from the upper level of the building to the lower level of the building; and an exhaust discharge device connected to the exhaust outlet available in a basement, so as to discharge exhaust in the hoistway and maintain air in the hoistway flowing in a single direction.

The air flowing direction is regulated by the air circulating device (taking in fresh air) installed on the top level of the building, the exhaust discharge device (discharging exhaust) installed in the basement, and the current directing device installed between two different levels according to the system of enhancing air quality for buildings. As a result, fresh air from the top of the building is introduced to the car in a top (higher level) to bottom (lower level) manner. Then, with the exhaust discharge device at the bottom level, dirty air is discharged out of the building. Also, the dirty air is re-directed via the current directing device installed between different levels to flow in a downwardly direction to prevent back flow of the dirty air, so as to increase amount of fresh air flowing in the car. Since the air quality is improved by implementing the system with available hoistway of the building, exhaust discharge device, and air venting ducts, the air quality in the elevator can be enhanced by system of the invention regardless of whether elevator of the building is old or new, without being limited to structure of the multi level building.

BRIEF DESCRIPTION OF THE DRAWINGS

Other objects, advantages and novel features of the invention will become more apparent from the following detailed description when taken in conjunction with the accompanying drawings, in which.

DETAILED DESCRIPTION OF THE PREFFERED EMBODIMENT OF THE PRESENT INVENTION

Reference will now be made to the drawings to describe the preferred embodiment of the present invention in detail. Unless specifically noted, the words and phrases in the specification and claims are intended to have their ordinary and accustomed meaning to those of ordinary skill in the applicable arts.

Figure 1:
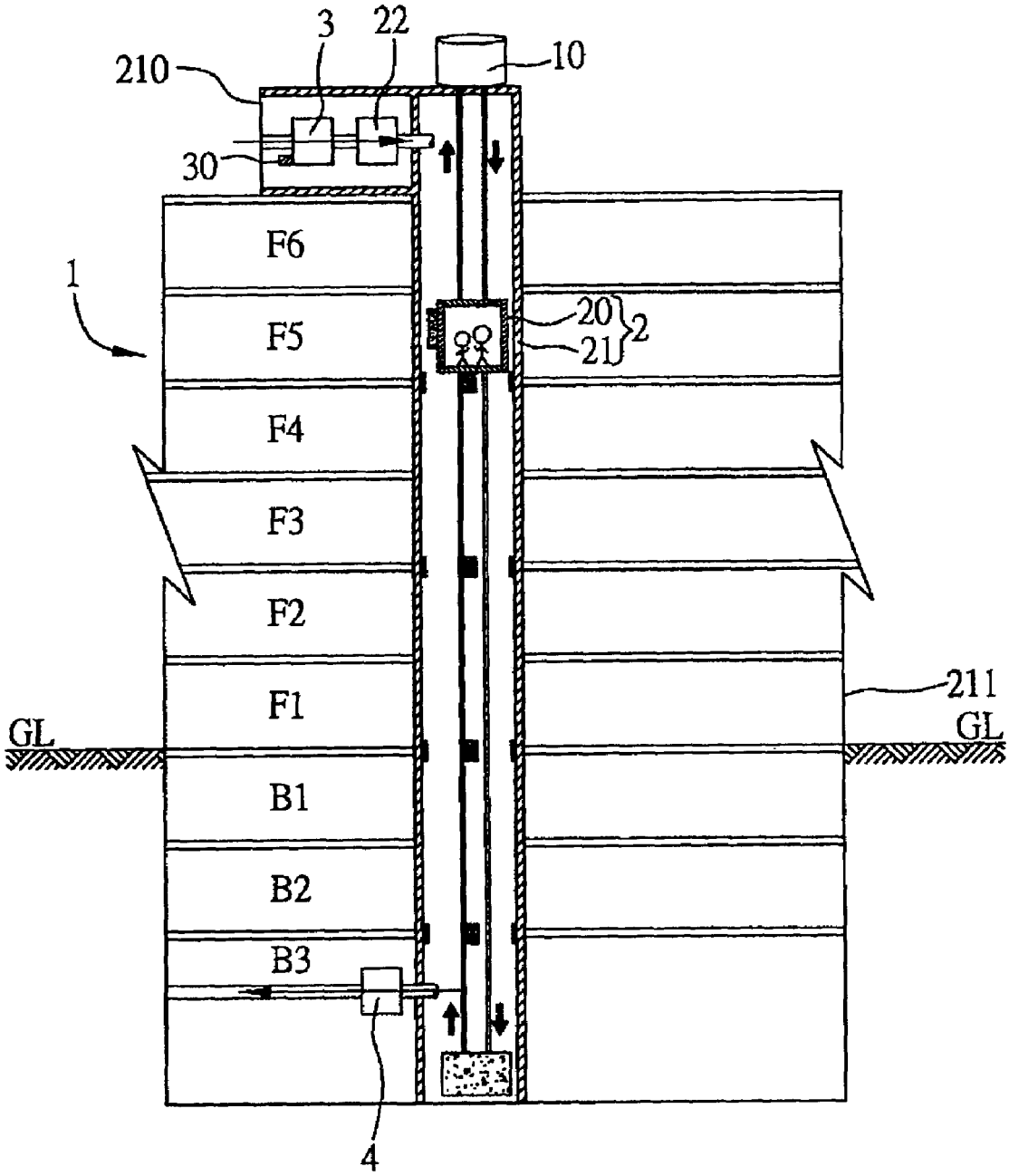
FIG. 1 is a schematic cross-sectional view of a building constructed with a system of enhancing air quality for buildings according to a preferred embodiment of the present invention.

Referring to FIG. 1, the system of enhancing air quality for buildings according to the present invention is constructed for a multi level building 1, such as a business building, commercial building or other similar building equipped with an elevating equipment or elevator 2. In an example of the multi level building 1 with six levels above and two levels below the ground, the elevator 2 for carrying passengers or cargos is constructed within the multi level building 1, and the elevator 2 further comprises a car 20, a hoistway 21 for receiving the car 20 moving vertically therein, and both ends of the hoistway 21 are installed on a top level (shown by F6 in the diagram) and bottom level (shown by B2 in the diagram) of the multi level building 1, respectively.

The hoistway 21 is generally a longitudinal frame structure having a rectangular cross-section, and vertically extends through levels of the multi level building 1, for creating a vertical travel passageway for an elevator installation of the car 20. A venting inlet 210 is arranged around an upper portion of the hoistway 21 to serve as an entrance for introducing fresh air from outside of the multi level building 1 into the hoistway 21. Similarly, an exhaust outlet 211 is arranged around a lower portion of the hoistway 21 to serve as an exit for discharging dirty air from the hoistway 21 out of the multi level building 1. An air circulating device 3 such as an air feeding machine is provided for introducing the fresh air into the hoistway 21. The air circulating device 3 is disposed around the venting inlet 210. The air circulating device 3 may further be equipped with an alarm-type auto shutdown system 30. The auto shutdown system 30 is provided for automatically shutting down power and regulating air feeding amount by stopping the air circulating device 3 from introducing the fresh air into the hoistway whenever fire breaks out in the building 1. An air filtering device 22 is preferably provided adjacent to the venting inlet 210 for purifying the fresh air introduced by the air circulating device 3, so that the filtered fresh air can be provided to the hoistway 21. The air filtering device 22 may be an ozonized means for killing germs, a photo-catalyzed means for killing germs, or a dustproof filter for filtering germs. The air filtering device 22 is generally disposed adjacent to the suction ventilator 3. In the meantime, the dirty air in the hoistway 21 can also be discharged via the available vehicle paths leading out of the car park in the basement or the exhaust outlet 211. An air-exhausting ventilating system such as an air purifying device 4 is also provided in the basement for discharging the dirty air.

Figure 2:
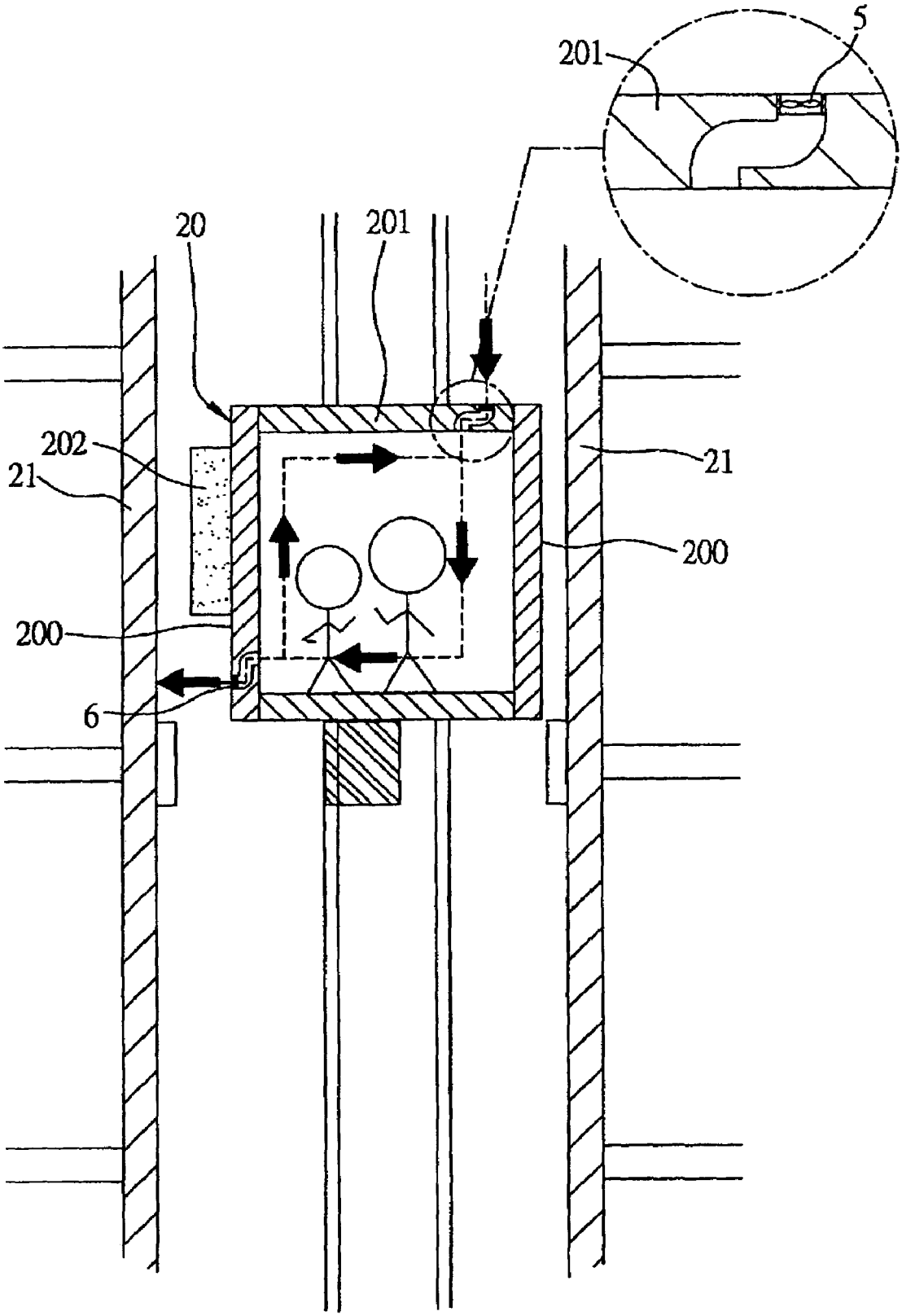
FIG. 2 is a schematic cross-sectional view showing a car in the system of enhancing air quality for buildings according to the preferred embodiment of the present invention.

According to the system of enhancing air quality for buildings, fresh air is introduced to the hoistway 21 via the air circulating device 3 installed on the top level of the multi-level building 1, so as to exchange with the air generated as a result of the car moving vertically in the hoistway. As shown in FIG. 2, the car 20 includes a elevator cage 200 spaced apart from a sidewall of the hoistway 21, a ceiling compartment 201 formed on top of the elevator cage 200, and a gravity balance part 202 formed behind a sidewall of the elevator cage 200. And the car 20 is driven by an electric-driven device (shown by numerical 10 in FIG. 1) mounted on the top level of the multi-level building 1, so that the car 20 can move vertically with cable between different levels of the multi-level building 1.

At least an air-feeding device 5 is installed in the ceiling compartment 201 for introducing the fresh air at the top level into the car 20, and at least an air extracting device 6 is additionally installed on the sidewall of the elevator cage 200 ten centimeters above a floor of the elevator 2 for discharging exhaust out of the car 20. As both the air feeding device 5 and the air extracting device. 6 are activated to generate convection and increase air circulation in the car 20, the fresh air is quickly introduced and dirty air is discharged out, so as to minimize chance of elevator passengers contracting with air-borne infectious disease (such as severe acute respiratory syndrome (SARS), fever, or tuberculosis) or chance of the elevator passenger being disturbed by irritating odors (such as smoke and fungus smell).

According to the system of enhancing air quality for buildings, the direction of air flow in the hoistway is stably controlled to prevent scattering of dirty air, while amount of air circulating in the car is increased, so as to enhance quality for feeding air in the car.

Figure 3A:
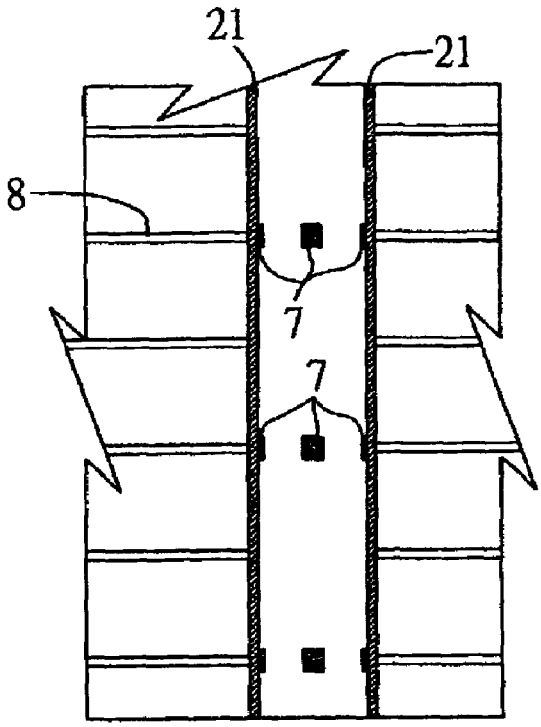
FIG. 3A is a schematic cross-sectional view of the building installed with a current directing device in the system of enhancing air quality according to the preferred embodiment of the present invention.
Figure 3B:
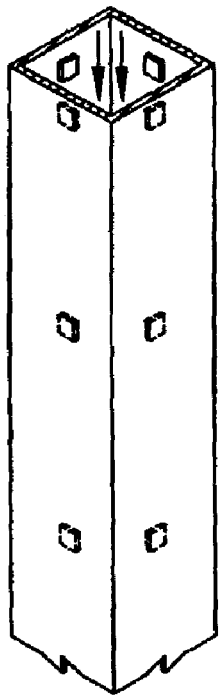
FIG. 3B is an elevational and perspective view of the current directing device of FIG. 3A.

A plurality of current directing devices 7, such as electric fans or ventilators, illustrated in FIGS. 3A and 3B, are preferably arranged at each intermediate levels 8 between the venting inlet 210 and the exhaust outlet 211. The current directing devices 7 are provided for directing the fresh air flowing along the hoistway 21 from the venting inlet 210 to the exhaust outlet 211. In the present embodiment, each of the current directing devices 7 is installed on the hoistway, such as a RC channel, and accommodated at a gap behind the gravity balance part 202 of the car 20, so that the air from the current directing device 7 flows in a top (high level) to bottom (low level) manner as illustrated in FIG. 3B, while the air flow is maintained in a single direction.

Figure 4:
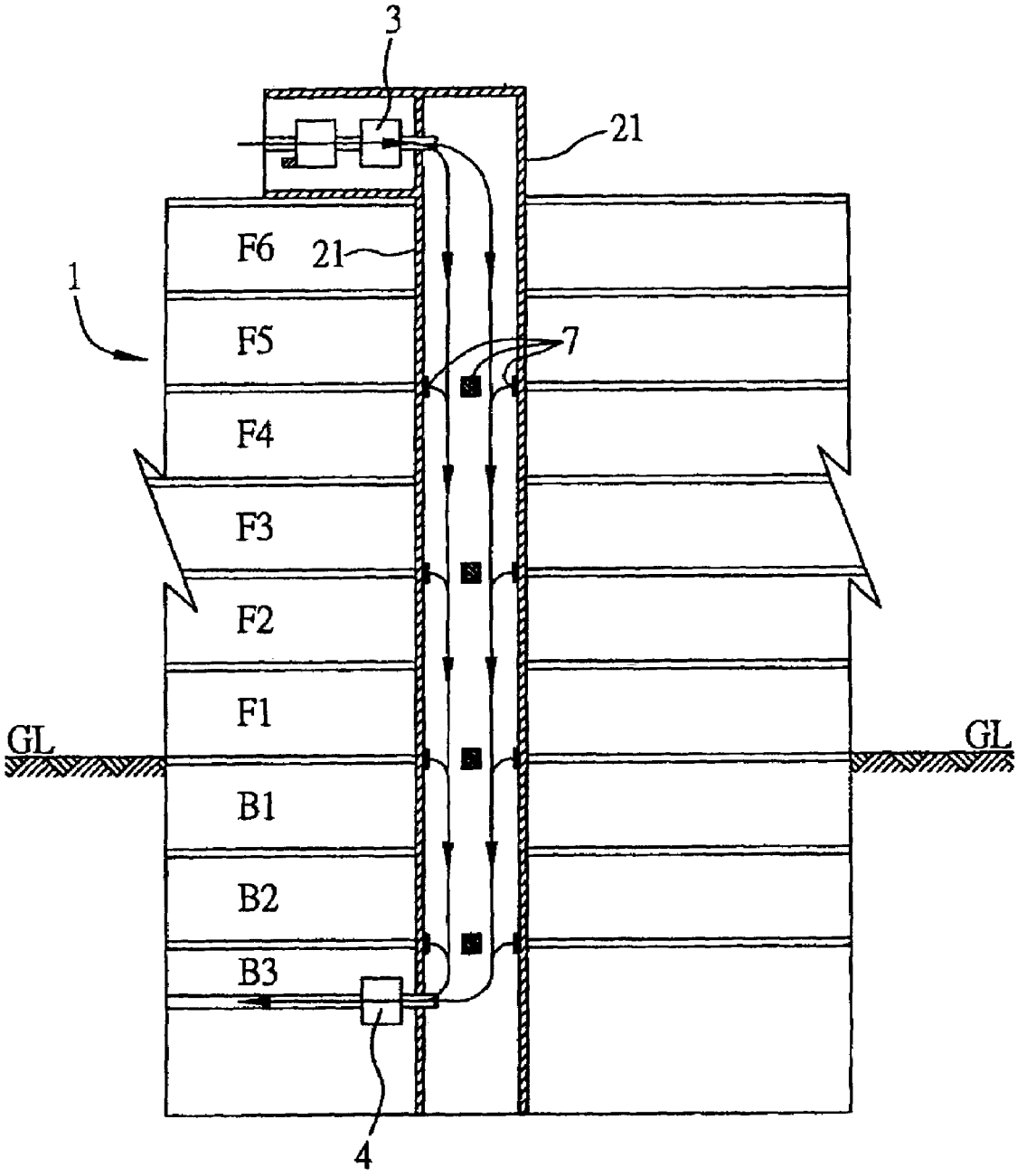
FIG. 4 is a schematic diagram indicating flow of the air in the hoistway of the multi level building having the system of enhancing air quality according to the preferred embodiment of the present invention.
Figure 5:
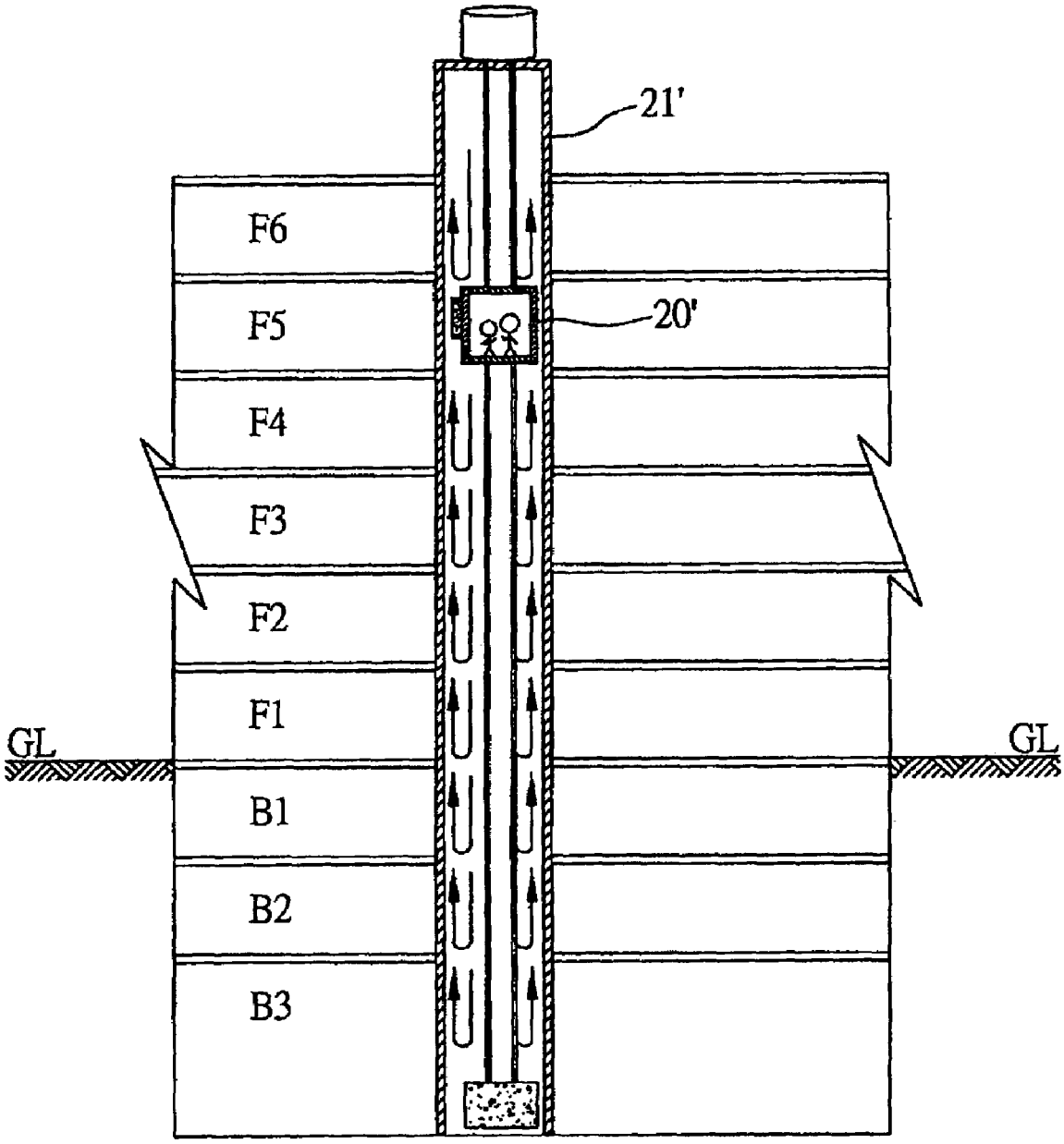
FIG. 5 (PRIOR ART)
FIG. 5 is a schematic cross-sectional view showing a the multi level building having an elevating equipment according to a prior art.

Now referring to FIG. 4, the direction of air flow in the hoistway 21 is regulated by the air circulating device 3 (taking in fresh air) installed in the top level of the building, the air purifying device 4 (discharging exhaust in the hoistway 21) installed in the basement car park, and the current directing device 7 installed between two different levels of the building. As a result, the fresh air is introduced in a top (higher level) to bottom (lower level) manner to the car (not shown), and the dirty air recycled from the car is discharged via the air purifying device 4. Meanwhile, back-flowing dirty air is re-directed via the current directing device 7 to flow downwardly to achieve a single flow direction (i.e. fresh air introduced from top level is exchanged in the car and the exhaust is discharged out of the basement). This prevents backflow of the dirty air from degrading quality air feeding in the car.

Accordingly, the air ventilation and convection is significantly increased both in the elevator and the hoistway, resulting in a much reduced chance of infectious diseases such as, for example corona virus infection for anyone traveling in the elevator car. Moreover, due to the improved air ventilation and convection, the accumulation of contaminants, dirt or other hazard materials in the hoistway of prior art is desirably avoided. And since the system of the present invention enhances air quality in the car via available hoistway, exhaust discharge device, and air feeding device between different levels, the system is implemented without limitation from shape and structure of the multilevel building. Therefore, the air quality in the elevator can be improved by implementing the system of the present invention, regardless of whether the elevator of the building is old or new.

While the preferred embodiment in accordance with the present invention has been shown and described, equivalent modifications and changes known to persons skilled in the art according to the spirit of the present invention are considered to be within the scope of the present invention as defined in the appended claims.

What is claimed is:

1. A system of enhancing air quality used for buildings comprising a multi-level building having a hoistway vertically extending through at least two levels of the multi-level building, for receiving at least a car vertically moving therein, an exhaust outlet connected via the hoistway to a bottom level of the multi-level building, and the car having at least an air feeding device and an air extracting venting device, the system comprising:

at least an air circulating device installed at a top level of the multi-level building, for introducing fresh air into the hoistway;

a plurality of current directing devices installed between two different levels of the multi-level building, for directing an air current in the hoistway flowing from an upper level of the building to a lower level of the building; and an exhaust discharge device in communication with the exhaust outlet available in a basement, for discharging exhaust out of the hoistway and maintaining air in the hoistway flowing in a single direction.

2. The system of claim 1, wherein the multi-level building is a building with at least more than three levels.

3. The system of claim 1, wherein the car is an elevator car.

4. The system of claim 1, wherein the car further comprising an elevator cage spaced apart from a sidewall of the hoistway, a ceiling compartment formed on top of the elevator cage, and a gravity balance part formed behind a sidewall of the elevator cage.

5. The system of claim 1, wherein the air feeding device and the air extracting devices operate simultaneously in the car to generate a convectional circulation.

6. The system of claim 1, wherein the air feeding device is installed in the ceiling compartment of the car.

7. The system of claim 4, wherein the air feeding device is installed in the ceiling compartment of the car.

8. The system of claim 1, wherein the air feeding device directing air current from the upper level of the building to the car.

9. The system of claim 1, wherein the air extracting device is installed on the hoistway and accommodated in a gap behind the gravity balance part of the car.

10. The system of claim 4, wherein the air extracting device is installed on the hoistway and accommodated in a gap behind the gravity balance part of the elevator cage.

11. The system of claim 1, wherein the air extracting device discharging air in the car to the hoist way.

12. The system of claim 1, wherein the air circulating device is an air feeding machine.

13. The system of claim 12, wherein an air filtering device is formed adjacent to the air feeding machine.

14. The system of claim 13, wherein the air filtering device is an ozonizing means for killing germs.

15. The system of claim 13, wherein the air filtering device is a photo-catalyzed means for killing germs.

16. The system of claim 13, wherein the air filtering device is a dustproof filter for filtering germs.

17. The system of claim 1, wherein the exhaust discharge device is an air purifying means for treating exhaust air in the basement.

18. The system of claim 1, wherein each of the current directing device is an air discharging machine directing the air current flowing downwards.

19. The system of claim 1, wherein each of the current directing device is an electric fan.

20. The system of claim 1, wherein the current directing devices are installed between every two levels of the multi-level building.

* * * * *